US005364053A

United States Patent [19]

Rodgers

[11] Patent Number: 5,364,053

[45] Date of Patent: Nov. 15, 1994

[54] HANGER DEVICE

[76] Inventor: Robert A. Rodgers, R.D. #6 Vetrans Rd., Mercer, Pa. 16137

[21] Appl. No.: 899,286

[22] Filed: Jun. 16, 1992

Related U.S. Application Data

[63] Continuation-in-part of Ser. No. 565,721, Aug. 13, 1990, abandoned.

[51] Int. Cl.[5] ..... A47H 1/16

[52] U.S. Cl. ..... 248/302; 52/506.07; 248/327; 248/343

[58] Field of Search ..... 248/328, 327, 302, 303, 248/231.91, 59, 343; 211/119; 52/484, 486; 267/166, 74; 24/707.3, 131 C; 411/999, 966, 970

[56] References Cited

U.S. PATENT DOCUMENTS

| | | | |
|---|---|---|---|
| 2,156,639 | 5/1939 | Powell | 248/59 X |
| 2,910,738 | 11/1959 | McCorkell | 52/484 X |
| 2,947,505 | 8/1960 | Sheets | 248/302 X |
| 3,127,147 | 3/1964 | Spangenberg | 248/327 |
| 3,159,251 | 12/1964 | Becker | 52/484 X |
| 3,352,430 | 11/1967 | McAtee | 211/119 |
| 3,493,206 | 2/1970 | Albro | 248/327 X |
| 3,502,129 | 3/1970 | Negoro | 411/970 X |
| 3,748,804 | 7/1973 | DeGeorge | 52/484 |
| 3,863,879 | 2/1975 | Herb | 248/327 |
| 4,305,557 | 12/1981 | Kowalski | 248/327 X |
| 4,429,797 | 2/1984 | Collins | 211/119 |
| 4,979,715 | 12/1990 | Rancourt | 248/302 X |

FOREIGN PATENT DOCUMENTS

| | | | |
|---|---|---|---|
| 0250558 | 12/1963 | Australia | 52/484 |
| 0251787 | 5/1964 | Australia | 52/484 |
| 0006718 | 12/1906 | France | 52/484 |
| 2622432 | 5/1977 | Germany | 248/59 |

*Primary Examiner*—Ramon O. Ramirez
*Attorney, Agent, or Firm*—George C. Atwell

[57] ABSTRACT

An apparatus for hanging suspended ceiling structures from an overhead surface, such as a spanning joist or beam, includes a fastener adapted for adjustable securement into the overhead surface and a flexible, elongated, suspension wire having a first end for attachment to the fastener and a second end for attachment to the suspended ceiling structure. Integrally formed from the wire at the first end are a plurality of adjacent coils which are adapted to encompass the fastener. The coils loosely contact the fastener so that free rotation of the fastener, for selective adjustment in the overhead surface, can be accomplished without turning and binding the pendent wire.

2 Claims, 2 Drawing Sheets

HANGER DEVICE

BACKGROUND OF THE INVENTION

This is a continuation-in-part of application Ser. No. 07/565,721, filed Aug. 13, 1990, in the United States Patent and Trademark Office, now abandoned.

This invention relates generally to suspended ceilings, and more particularly pertains to an improved apparatus for hanging suspended ceiling structures from an overhead surface, such as a room-spanning joist or beam.

Suspended ceilings are an attractive way to finish a room or conceal existing flaws in the pre-existing ceiling. Ornately patterned ceiling tiles, some of which may contain recesses for placement of uniquely designed lighting fixtures, are utilized by home builders and home remodelers for the aesthetic and monetary enhancement of a dwelling or residence.

Various retailers and ceiling tile manufacturers provide kits for installing suspended ceilings; therefore, the tools and materials required, as well as the steps necessary for successful completion of the task, must be consonant with the level of skill of the typical do-it-yourself home remodeler in addition to being reasonably priced.

The steps necessary to install a suspended ceiling in, for example, a family room include accurately marking, on each wall, the proper height for the securement of wall angles which run the perimeter of the room; the wall angles being equal in height and touching at the room corners. Chalklines are marked on the ceiling to represent the grid layout of each suspended ceiling tile. From spaced-apart nails driven into each wall immediately beneath the wall angles, strings are attached and then extended across the room for attachment to nails secured in the opposite wall.

The level of the strings indicate the level of the suspended ceiling structures, i.e., the channels (or runners) and cross-T's. The channels are hingeably attached to the wall angles and extend from one wall to the opposite wall. Cross-T's are hingeably fitted to the channels and run perpendicular to the channels, thus forming the suspended ceiling gridwork on which the ceiling tiles are placed.

Before the cross-T's can be fitted to the channels, the channels must be further secured to an overhead surface, such as a joist or beam. The lightweight, pliable channels may extend across a twelve-foot, twenty-foot, or longer space. Without overhead support and, obviously, having no ground-based support, the channels would bow, sag, and become unhinged from the wall-mounted wall angles due to the combined weight of the cross-T's and the ceiling tiles. Therefore, some type of apparatus must be employed to provide the channels with overhead support.

For this purpose, various hanger devices are used. The hanger devices are sold separately or as an accessory with the ceiling tiles and ceiling structures. One hanger device comprises a threaded screw with an eyelet and an elongated wire. The screw is manually inserted into (preferably) pre-drilled, spaced-apart holes in the overhead spanning joists or beams. One end of the flexible wire is twisted through the eyelet and the other wire end is twisted around the pre-formed slots in the channels.

One variation on this standard hanger device is for the threaded screw to include a C-shaped hook instead of an eyelet. One end of an elongated, flexible wire is looped around the hook while the other end is twisted around one of a number of spaced-apart channel holes or slots integrally formed on the channel.

Yet another type of hanger device comprises a J-shaped fastener and an elongated, flexible wire bent equally in half. The first step in utilizing this type of hanger device is to secure the J-shaped fastener to the joist or beam. The fastener is hammered into the joist but not secured flush to the joist. A small gap is left through which the wire can be inserted, with the bend in the wire resting upon the J-shaped fastener and both long strands of the wire hanging down therefrom. Each long strand is then tied to the channel, thus achieving overhead securement of the channel.

Certain disadvantages of the aforementioned hanger devices are apparent. Hammering or hand turning a fastener into an overhead joist while standing on a ladder is difficult and cumbersome. Tying a portion of the wire around the screw eyelet or tying a loop around the C-shaped hook is also awkward while standing on a ladder.

Most significantly, however, the channels will always need leveling due to the inherent pliable construction of the channels, i.e., the channels must be lightweight and pliable so that they can be easily carried up a ladder and held in place for securement to an overhead surface. Retying the wire ends to take up or allow more slack for leveling the channels is one cumbersome and inexact way to level the channels. Adjusting the fasteners by hand turning or using pliers is also another awkward, cumbersome way to level the channels.

Accordingly, it is a primary object of the present invention to provide an improved hanger device having numerous practical advantages when compared with the aforementioned and widely-used hanger devices.

More particularly, it is an object of this invention to provide an improved hanger device whose structure provides simple and efficient utilization and adjustment during the installation of suspended ceiling tiles.

Other objects of the apparatus of the present invention will become apparent as the description herein proceeds.

SUMMARY OF THE INVENTION

The present invention comprehends an improved hanger device for securing suspended ceiling structures from an overhead surface during installation of a suspending ceiling. The apparatus of the present invention is an improved hanger device for use by both building contractors and do-it-yourself home remodelers, and includes a fastener adapted for adjustable securement into an overhead surface such as a ceiling-spanning joist, beam, or rafter.

An elongated, flexible suspension wire is removably attached at one end to the fastener and suspends or hangs downward therefrom so that a second wire end can be removably secured to a ceiling structure, such as wall-to-wall transversely-extending channels or runners. The length of the wire determines the distance the ceiling structures are pendent from the overhead surface.

The fastener is an elongated screw having a threaded shaft portion, an unthreaded shaft portion, and a circular-shaped hex head or Phillips head; in either case the head should have a diameter greater that the shaft portions.

The apparatus further includes a wire having an integral coil means for attaching the wire to the fastener so that the fastener can freely rotate for selective adjustable securement into the overhead surface without turning, twisting, or binding the pendent wire. More specifically, the coil means includes a plurality of coils integrally formed from the wire at the first wire end. The coils have a diameter sufficient to adjacently encompass the unthreaded shaft portion when the hanger is disposed in its operative position. The diameter of the coils also permits the wire to be removably attachable to the fastener; thus, if any portion of the wire reveals cuts thereon that could cause the wire to break, the wire can be removed from the fastener and replaced.

A paramount advantage of the present invention is that the integral coil means permits the fastener to freely rotate during adjustable securement while at the same time maintaining the pendent wire in its stationary, generally vertical position with the second wire end secured to the transversely-extending channel.

This is due to the fact that during attachment of the channels to the wall angles or suspension from the joists or rafters by the hanger device of the present invention, the channels may be unevenly positioned due to slight measurement discrepancies in the laying out of the wall angles or in the uneven securement of the fasteners into the joists or rafters.

Therefore, adjustments are necessary in order to level the channels. In the apparatus of the present invention, leveling the channels is accomplished by simply drilling the fasteners further into the joist or backing them out from it the appropriate distance.

A portable or cordless drill is all that is required for selectively adjusting the fasteners; manually turning a screw into or twisting it out of the joist or beam is unnecessary as is the cumbersome task of untying and retying the wire at either end of attachment.

The rotation of the fastener for selectively adjusting the suspended channel does not cause the concentric coils to also turn because the coils loosely encompass, but do not tightly encircle or wrap around the fastener. The twisting or binding of the pendent portion of the wire is thus avoided, such twisting or binding would cause the channels to be displaced from their level transverse extension and kink or cause undue stress to the wire.

In an alternate embodiment a securement means is utilized to attach the wire to the fastener so that the fastener can freely rotate when it is selectively adjusted without causing the pendent wire to twist or bind. The securement means includes a securement member attached to a fastener end of the wire and adapted for removable placement on the fastener. The securement member includes a round washer which defines an opening through which the fastener is inserted. Moreover, the annular opening permits the fastener to rotate while the wire remains stationary in its pendent operative position. The wire also has a flexible wrap end secured to the channel as heretofore described.

Yet another alternate embodiment of the apparatus of the present invention is to provide a wire with a loop means for attaching the wire to the fastener so that the fastener can freely rotate while the wire is maintained in its vertically-suspended operative position without binding or twisting. The wire loop means includes a single wire loop integrally formed from one wire end, the loop having a diameter which allows removable attachment to the fastener. When the wire is disposed in its operative position, the wire loop encompasses an unthreaded shaft portion of the fastener and is located adjacent the fastener's circular shaft head. When the fastener is backed into or out of the joist for selective adjustment of the ceiling structures, the fastener rotates but the wire loop and the suspended portion of the wire remain stationary.

Therefore, it is an object of the present invention to provide a simple and efficient device to suspend ceiling structures from an overhead surface. In addition, it is an object of the present invention to provide a method of wrapping the wire around the fastener which facilitates the free rotation of the fastener within the wire.

It is a further objective of the apparatus of the present invention to be easily utilized by an experienced craftsman or layman, and further that its utilization does not require complicated or numerous tools.

Yet another objective of the apparatus of the present invention is to provide a hanger device that is inexpensive to manufacture and easily assembled by the do-it-yourself home remodeler.

Other features of the invention and the advantages presented thereby will become apparent as the description herein proceeds.

DETAILED DESCRIPTION OF THE PREFERRED EMBODIMENT

Figure 1:
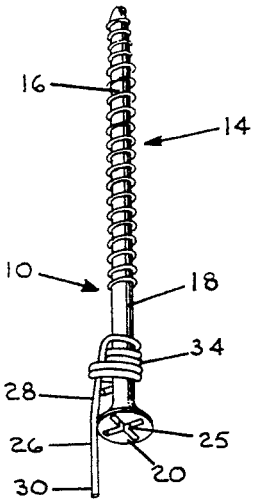
FIG. 1 is an isometric view of the preferred embodiment of the apparatus of the present invention.
Figure 2:
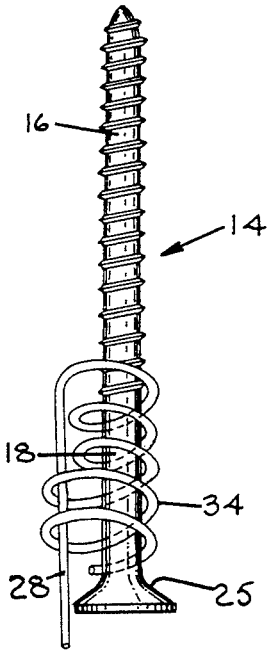
FIG. 2 is an enlarged perspective view of certain components of the apparatus first shown in FIG. 1.
Figure 3:
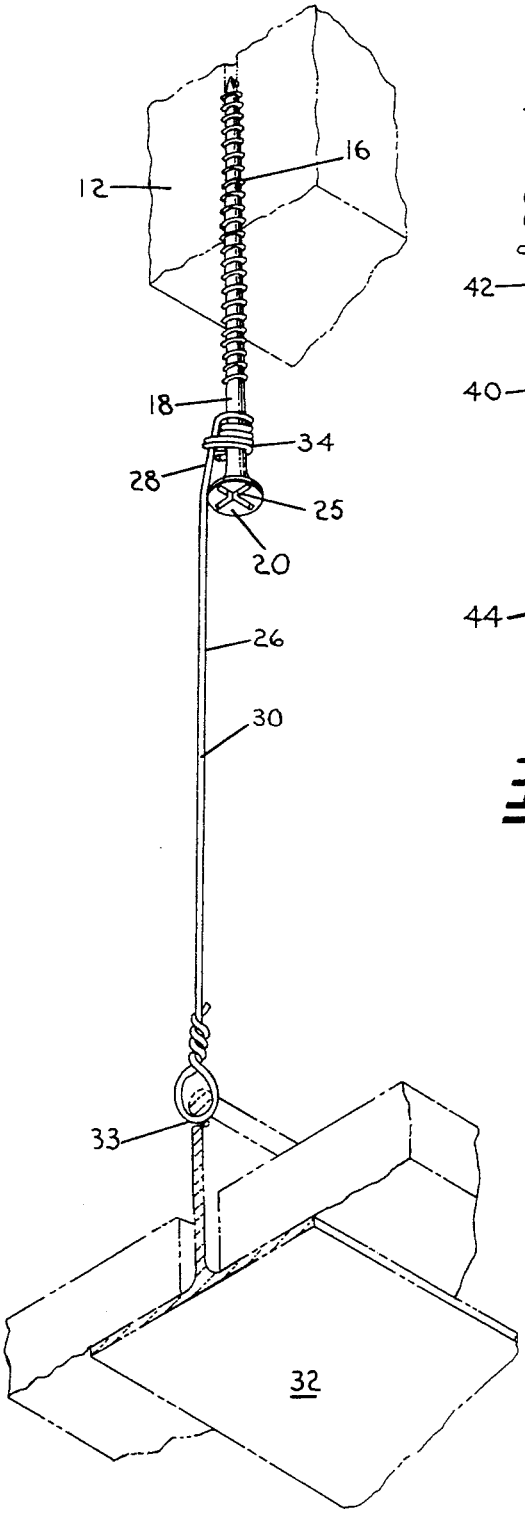
FIG. 3 is a perspective view of the apparatus with some structures shown sectionally to illustrate the actual use or function of the present invention first shown in FIG. 1.

FIGS. 1 through 3 illustrate an apparatus for hanging suspended ceiling structures from an overhead surface, such as a spanning joist, beam, or rafter. The apparatus of the present invention is an improved hanger device 10 used for the installation of suspended ceiling tiles by both professional building contractors and do-it-yourself home remodelers. In FIG. 3, a standard overhead ceiling includes a plurality of spaced-apart joists 12 (one of which is shown) extending transversely across and hidden by the ceiling. As will be hereinafter further described, the hanger device 10 of the present invention can also be utilized with an overhead ceiling lacking spanning beams or rafters.

FIG. 1 shows an elongated, rigid fastener 14 adapted for adjustable insertion and securement into an overhead surface, more specifically, through the overhead ceiling and into a spanning joist 12. The fastener 14 has an elongated, rigid shaft which further includes a threaded shaft portion 16, an intermediate unthreaded shaft portion 18, and a circular-shaped fastener head 20 transverse to the shaft. The fastener 14 may be a wood screw, a drywall screw, or a sheet metal screw, although, for most uses, a wood screw is preferred. For the most effective use, the fastener 14 should be at least two and one-half inches long. In the apparatus of the present invention, the fastener 14 is three and one-half inches long. The diameter of the circular-shaped or round fastener head 20 should be greater than that of both the unthreaded shaft portion 18 and the threaded shaft portion 16. The fastener head 20 may be either a hex head 22, with an integral abutment flange 24 (shown in FIG. 4), or a Phillips head 25 as shown in FIG. 1.

FIGS. 1 and 3 illustrate an elongated, flexible suspension wire 26 attached to the fastener 14. The wire has a flexible first wire end 28 which is attached to the fastener 14, when the hanger device 10 is disposed in its operative position, and an oppositely-disposed flexible second wire end 30 attached to the suspended ceiling structure, such as a channel or runner 32. It should be obviously noted that the wire is flexible throughout its length. The wire 26 may be of various gauges, although 18-gauge or 20-gauge is preferred. In addition, the length of the wire 26 may vary, however, wire lengths of at least two feet are necessary for the proper hanging of the suspended channels or runners 32. In the preferred embodiment of the apparatus of the present invention, 18-gauge wire with a length of two feet is utilized.

When installing suspended ceiling tiles, the transversely-extending channels or runners 32 are secured to oppositely-disposed side walls a pre-established distance above the floor. A distance must also be measured from the ceiling downward to allow sufficient space for heating ducts, electrical conduits, lighting fixtures, etc. A common height for installing ceiling tiles is seven feet six inches. After the appropriate height for the ceiling tiles is determined, the walls of the room are marked and supports, such as wall angles, are secured to each wall. The wall angles extend the perimeter of the room and are in contact with each other at the corners of the room. Usually, a string grid or a chalk grid is laid out on the ceiling to mark and define the area in which the ceiling tiles will be placed and to mark and define the location of the channels, which will extend transversely from one wall to the oppositely-disposed wall, and the cross-T's, which will be placed perpendicular to the transverse extension of the channels. The channels are hingeably attached to the wall angles, and the cross-T's are hingeably attached to the channels.

Before the channels are secured to the wall angles, however, points on the overhead ceiling corresponding to the location of the joists or rafters must be marked for insertion of some type of the fasteners. The distance between each fastener is determined by the length and width of the room and the particular size of the ceiling tiles being installed. After the spaced-apart points are marked, the holes are pre-drilled and then securement thereinto of the fasteners can commence. Pre-drilling of the holes would be required if the joist was constructed of metal or steel.

In the apparatus of the present invention, as shown in FIGS. 1 through 3, the fastener 14 is a self-tapping screw which does not require pre-drilling holes in the overhead joist 12. The fastener 14 is simply positioned at the appropriate point and it is inserted into the joist 12 by a power tool. Thus, the extra and time-consuming step of pre-drilling each hole before the fasteners can be inserted is avoided.

In the preferred embodiment of the apparatus of the present invention as illustrated in FIGS. 1 through 3, the suspension wire 26 is adapted to be removably attachable to fastener 14. One reason the wire 26 is not integrally attached to the or formed to the fastener 14 is to reduce costs in the manufacturing and packaging of the hanger device 10 of the present invention. Another reason is that if the wire 26 is integrally attached or formed to the fastener 14 and the wire 26 is broken or bent during manufacture, transport and sale, or installation, the fastener 14 would also be rendered useless. If the wire 26 and the fastener 14 are separately packaged and removably attached one to another, then impairment of one does not render the other useless.

In the hanger device 10 of the preferred embodiment of the present invention, fasteners (one of which is shown in each of FIGS. 1, 2, and 3) are secured into the joists 12 at the premarked spots or points. Before each fastener 14 is secured into the overhead joist 12, the wire 26 is attached to the fastener 14 at the first wire end 28. The first wire end 28 is merely slipped over the fastener 14 until it rests generally at the unthreaded shaft portion 18 of the fastener 14. With the wire 26 thus attached to the fastener 14, the fastener 14 can be insertably secured into the overhead joist 12 by use of a cordless drill or a power drill. The second wire end 30 of the suspension wire 26 is tied or wrapped around the channel 32 through one of a number of pre-formed, spaced-apart slots or holes 33 located on the channel 32. Thus, starting at the wall angles at one wall, each channel 32 is extended outwardly across the room at the already predetermined height. Each removably attachable wire 26 is slipped over the corresponding fastener 14, the fastener 14 is insertably secured into the joist 12, and the second wire end 30 is tied to the channel 32.

As shown in FIG. 3, the hanger device 10 is placed in its operative position and then the channel 32 is mounted by successively tying each suspension wire 26, which is pendent from the fastener 14 when the fastener 14 is secured to the overhead joist 12, until the channel 32 is adequately secured. This procedure is repeated with the next channel 32 which is placed contiguous and linearly to the already installed channel 32 until the channels extend across the room. For each pendent suspension wire 26, there is a corresponding channel slot or hole 33 through which the wire 26 is securably tied or wrapped. After the channels 32 are installed, cross-T's are attached perpendicular to the extension of the channels 32. After the cross-T's have been hingeably mounted to the channels 32, the ceiling tiles are ready for placement in the grids formed by the right-angled crossing of the cross-T's and the channels.

One problem often encountered in the installing of ceiling tiles is that the channels may not be level, i.e., the channels may slope downward or upward from one wall to the opposite wall, or, one channel may not be precisely level with the adjacently spaced-apart channel, or, all the channels extending across the length or width of the room may vary in height. Even slight variations in the height of the channels will cause the improper installation of the ceiling tiles. Therefore, all the channels must be leveled, one to another, for the proper installation of a suspended ceiling.

As illustrated in FIGS. 1 through 3, the hanger device 10 of the present invention provides a simple and efficient way to quickly level each suspended channel 32. More specifically, the preferred embodiment of the apparatus of the present invention includes a wire 26 having an integral coil means for attaching the wire 26 to the fastener. The coil means includes a plurality of adjacent coils 34 integrally formed from the wire 26 at the first wire end 28. When the hanger device 10 is disposed in its operative position, the coils 34 define a coil opening having a diameter which is sufficient to permit the coils to slip over and adjacently and snugly encircle the unthreaded shaft portion 18 of the fastener 14; however, there is enough play or looseness to the coils 34 that removable attachment of the wire 26 from the fastener 14 is not prevented. At least one of the coils 34 is axially aligned with the threaded shaft portion 16 and the unthreaded shaft portion 18, and at least one of the coils 34 has an axis parallel to the suspension wire 26. Also, the diameter of the coil opening of the coils 34 is generally, and preferably, not greater than the diameter of the fastener head 20, in order to prevent the coils 34 from slipping or sliding over the fastener head 20 when the hanger device 10 is in its operative position.

When the apparatus of the preferred embodiment of the present invention is disposed in its operative position as illustrated in FIG. 3, the wire 26 is removably attached to the fastener 14 and the coils 34 encircle the fastener 14 adjacent the unthreaded shaft portion 18. Because of the wrapping of the coils (hereinafter more fully described), they do not rest upon the circular-shaped head 20 but are adjacent to it. The diameter of the coils 34 is sufficient to insertably receive the fastener 14, but not large enough to slip over the fastener head 20. Also, the particular method of wrapping the coils 34 as hereinafter described prevents their unraveling from the fastener 14 if a downward pressure is exerted on the ceiling structures or the ceiling tiles.

As shown in FIG. 3, if the channel 32 attached to the hanger device 10 requires leveling, selective adjustment of the fastener 14 is simple and easy to accomplish. A cordless or power drill is simply placed within the particular configuration of the fastener head 20 and the fastener 14 is then backed out of or inserted further into the spanning joist 12. One advantage of employing the coil means to attach the wire 26 to the fastener 14 is that when selective adjustable securement of the fastener 14 is required to level the channel 32, the fastener 14 can freely rotate into or out of the pre-drilled hole without causing a consequent turning, twisting, or binding of the wire 26. The loose and adjacent encirclement of the coils 34 around the fastener 14 allows the fastener 14 to rotate but maintains the wire 26 in its generally vertical, pendent position.

The coil means for attaching the wire 26 to the fastener 14 avoids the cumbersome task of untying or unwrapping that portion of the wire 26 that is connected to the channel 32 so that the fastener 14 can be drilled further into or backed out of its hole without binding the wire 26.

If the coils 34 were fixedly attached to the fastener 14, the rotation of the fastener 14 during selective adjustment would cause the coils 34 to turn and thus twist the wire 26, displacing the channel 32 from its suspended, transversely-extending position. In the preferred embodiment of the apparatus of the present invention, leveling of the channels 32 merely requires selective adjustment of the fasteners 14, either by backing them out of or drilling them further into the spanning joist 12. This is a simple and efficient way to level the channels 32 and avoids the cumbersome difficulty of untying and retying wires 26 at what would be the first wire end 28 and the second wire end 30, manually turning a screw further into or out of the joist 12, or even hammering or prying a nail or staple-type fastener further into or out of the joist 12.

As was mentioned previously, the method of wrapping the wire 26 is unique and facilitates the free rotation of the fastener 14, the secure attachment of the wire 26 to the fastener 14, and the removable attachment therefrom if necessary. The method of wrapping the wire 34, shown in its operative and completed position in FIGS. 1 through 3, comprises the steps of placing the fastener 14 in a horizontal position on a work table, for example. Next, is the positioning of the wire 26 parallel and adjacent to the fastener 14. Enough length of the first wire end 28 should be parallel to the fastener 14 in order to shape the coils 34. Therefore, measuring a length of wire 26 sufficient to form or shape the plurality of coils 34 to encircle the unthreaded portion 18 is next. Wrapping the wire 26 counter-clockwise around the unthreaded portion 18 at least twice in order to shape or form two coils that are axially aligned with, and snugly adjacent to, the unthreaded shaft portion 18 occurs next. In the next step, the wrap of the wire 26 continues so that at least two coils are formed which encircle both the unthreaded portion 18 and the length of wire 26 generally parallel to the unthreaded portion 18 adjacent the fastener head 20. The final step is finishing the wrap by twisting the remaining free wire 26 around the unthreaded portion 18. The successive wrapping of the coils, each coil may be slightly spaced-apart one from another or they may be contiguously wrapped, comprises a novel method of attachment of the suspension wire 26 to the fastener 14.

Figure 4:
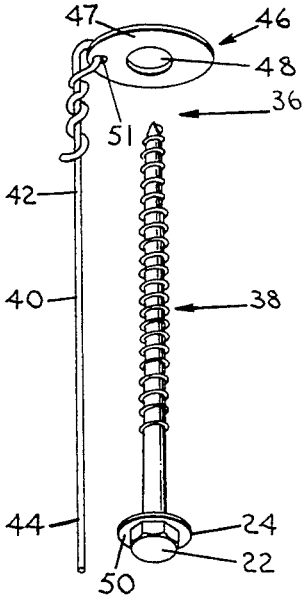
FIG. 4 is an alternate embodiment of the apparatus constructed in accordance with the present invention, showing various components in exploded view to reveal specific details.

FIG. 4 illustrates an alternate embodiment of the apparatus of the present invention. The hanger device 36 as shown in FIG. 4 includes a rigid, elongated fastener 38 adapted for adjustable insertion into an overhead support surface, as heretofore described, and an elongated, flexible wire 40 adapted for removable attachment to the fastener 38. The wire 40 is attached to the fastener 38 at a fastener end 42 while an oppositely-disposed wrap end 44 is adapted for removable securement to the suspended ceiling channel 32. The wrap end 44 is tied or wrapped around the channel slot 33 as was heretofore described.

As illustrated in FIG. 4, more specifically, a securement means is adapted for attaching the wire 40 to the fastener 38. The securement means includes a securement member 46 which may be square, hexagonal, or cylindrical-shaped and is located at and attached to the fastener end 42 of the wire 40. The securement member also includes a central bore 48 having a diameter greater than the fastener 38 to permit removable attachment of the wire 40 to the fastener 38. The central bore 48 insertably receives the fastener 38, and the securement member 46 is slid or slipped down the fastener 38 until it contiguously rests upon a cylindrical fastener head 50.

In FIG. 4, the securement member 46 shown is a round washer 47 having an inner annular opening which corresponds in structure and function to the central bore 48. The central bore 48 slips over the fastener 38 and the fastener 38 is inserted through the bore 48 of the washer 47. The washer 47 rests contiguous to the fastener head 50 which is circular-shaped and generally of the same diameter as the washer 47. When the hanger device 36 is disposed in its operative position, the wrap end 44 is attached to the channel hole 33 by wrapping or tying it therearound. The wire 40 must be attached and secured to the securement member 46; in FIG. 4, the washer 47 has an outer annular edge which has a wire insertion slot 51 integrally formed thereon, the slot 51 defining a diameter sufficient to receive therethrough the wire 40 for tying therearound. If the wire 40 must be removed, it is simply untied and removable attachment is thus accomplished.

For adjustable insertion of the fastener 38, the same procedure as heretofore described is utilized. The fastener 38 is either backed out of or inserted further into the spanning joist 12 by some type of drill. The bore of the washer defines a circumjacent space between the fastener 38 and the washer so that the fastener 38 can freely rotate without calxsing the washer to consequently rotate and thereby twist and bind the pendent wire 40. The fastener 38 can thus be adjustably inserted further into or backed out of the joist 12 to level the channel 32, without having to untie and retie the wire 40 at the wrap end 44 or manually turn the fastener 38 into or out of the joist 12.

Figure 5:
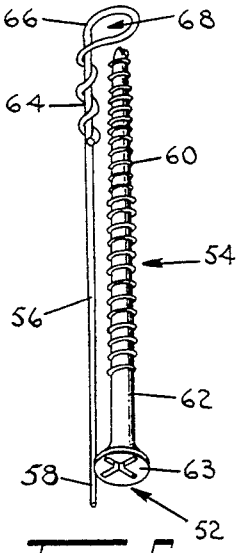
FIG. 5 is a second alternate embodiment of the apparatus constructed in accordance with the present invention, revealing details of certain components of the apparatus in exploded view.

FIG. 5 illustrates a second alternate embodiment of the apparatus of the present invention. The hanger device 52 shown in FIG. 5 includes an elongated, rigid fastener 54 adapted for adjustable insertion into the spanning joist 12 and an elongated, flexible wire 56. The wire has a tie end 58 adapted for removable securement to the ceiling structure, securement being the same as heretofore described, i.e, wrapping or tying the wire 56 around or through the channel slot 33. The fastener 54 includes a threaded portion 60, an unthreaded intermediate portion 62, and a round fastener head 63. A wire loop end 64 is oppositely-disposed the tie end 58 and is adapted for removable attachment to the fastener 54.

As shown in FIG. 5, a wire loop means is adapted for removably attaching the wire 56 to the fastener 58. More specifically, the wire loop means includes a single wire loop 66 located at the loop end 64 and integrally formed therefrom. When the hanger device 52 is disposed in its operative position, the wire loop 66 projects generally laterally from the pendent, and generally vertical, operative disposition of the wire 56. Furthermore, the wire loop 66 is adapted to adjacently encompass the fastener 54, the wire loop 66 being further defined by having a loop hole 68 with a diameter greater than the fastener 54.

When the improved hanger device 52 shown in FIG. 5 is disposed in its operative position, the single wire loop 66 is slipped over and onto the fastener 54 and adjacently encompasses the unthreaded portion 62. The fastener 54 is then adjustably inserted into the overhead spanning joist 12 and the tie end 58 of the generally vertically-suspended wire 56 is tied to the channel 32 at the channel slot 33. To level the channel 32, the fastener 54 is selectively adjusted by either backing it out of or drilling it further into the joist 12. The wire loop 66 loosely encircles the fastener 54 so that free rotation of the fastener 54 during selective adjustment can occur without consequently rotating the loop 66 and causing the pendent wire 56 to twist and bind. Thus, the channel 32 can be leveled without the need for untying and retying the wire 56 at both ends 58 and 64 or manually turning and adjusting the fastener 54.

Figure 8:
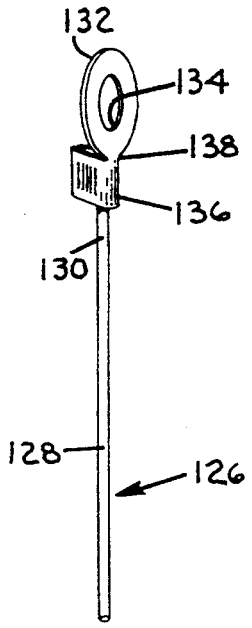
Figure 7:
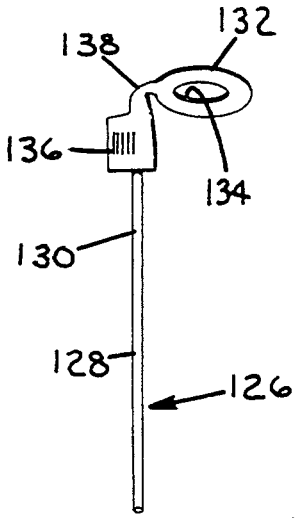
Figure 6:
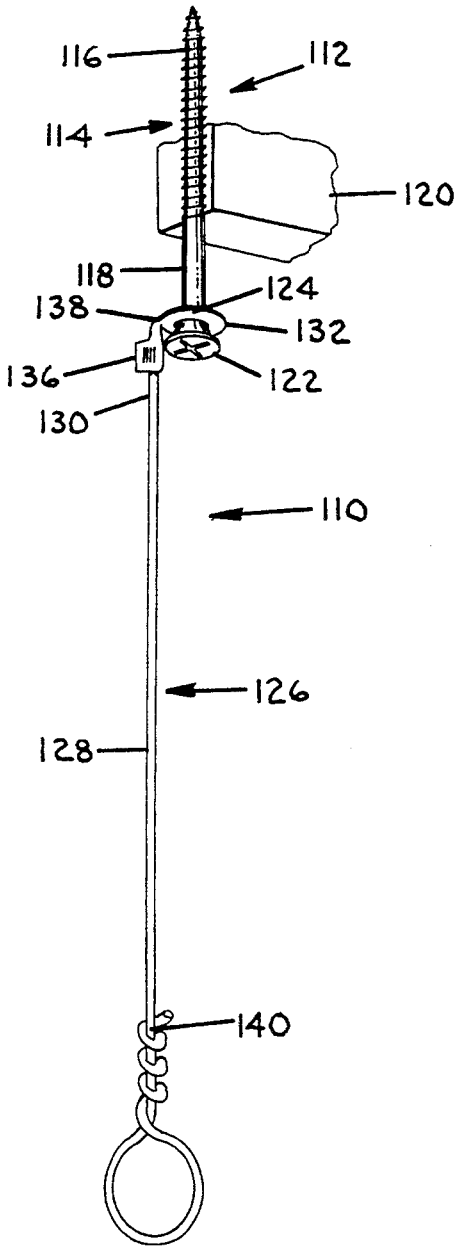

Referring to FIGS. 6–8, there is shown yet another alternate embodiment of an improved apparatus for hanging suspended ceiling structures from an overhead surface, such as transversely-extending ceiling joists or beams spanning a living room or basement. The improved apparatus is an improved hanger device 110 which includes an elongated, self-tapping screw fastener 112 which may be anywhere from one-half inch to three and one-half inches long. The screw fastener 112 has an elongated shank 114 with a threaded end 116 comprising substantially the length of the shank 114, and a non-threaded portion 118 comprising a much smaller area on the shank 114. The substantially threaded end 116 of the shank 114 allows the screw fastener 112 to be firmly and securely inserted into an overhead structure, such as a joist or beam 120 shown in FIG. 6. The screw fastener 112 includes a head 122 integrally attached to the shank 114 adjacent the unthreaded portion 118 and having a diameter greater than the diameter of the shank 114. The head 122 can be shaped to receive either a Phillip's head or a flat screwdriver or drill bit mounted to an electric drill; in either case, the head 122 is adapted to be engaged by a tool to rotationally drive the screw fastener 112 into the overhead structure, to remove the screw fastener 112 from the overhead structure, if necessary, and to insert and then selectively adjust the screw fastener 112 by extending it into and backing it out of the overhead structure during the process of hanging and leveling the suspended ceiling structures, such as main runners or channels and cross-T's (not shown).

A neck portion 124 of the shank 114, which is intermediate the non-threaded portion 118 and the head 122, has a smaller diameter or transverse dimension than the head 122.

In addition, a wire member 126 is utilized with the screw fastener 112 for vertical disposition and operative cooperation therewith. The wire member 126 has a thin, pliable, elongated wire body portion 128 and a first end 130 which is an integral extension of the wire body portion 128. Located at the first end 130, and secured thereto, is a ring-like shape 132 defining an aperture 134 to accommodate insertion and extension therethrough by the fastener 112.

FIG. 8 illustrates the ring-like shape 132 when disposed in its non-operative position, such as when it would be contained within clear or hard plastic packaging for display on a store shelf. The ring-like shape 132 can be integrally formed from the wire member 126, or, as shown in FIGS. 6–8, the ring-like shape 132 can be secured or affixed to the first end 130 of the wire member 126. An attaching portion 136 is adapted to be slipped on and firmly crimped to the first end 130. The attaching portion 136 can also be soldered onto the first end 130.

Between the attaching portion 136 and the ring-like shape 132 is a flexible portion 138 which may have slightly less thickness than the ring-like shape 132. The flexible portion 138 allows easy bending for inserting the screw fastener 112 through the ring-like shape 132 and for allowing the wire body portion 128 to be pendently disposed so that a means at an opposite second end 140—either an integral J-hook formed at the second end 140 or a metal hook affixed thereto—can be quickly hooked onto, wrapped around or tied to the suspended ceiling structure. FIG. 6 shows the wire member 126 disposed in its operative position with the screw fastener 112 fully inserted through the aperture 134 of the ring-like shape 132, and freely rotatable therein, with the ring-like shape 132 supported by the head 122 of the screw fastener 112.

In order to assure that the screw fastener 112 will freely rotate within the aperture 134 without the rotating head 122 impinging the pendent wire body portion 128 or causing the wire body portion 128 to twist and bind and consequently adversely affect the level, horizontal disposition of the suspended ceiling structure to which the second end 140 is attached, spacing and clearances for the several structural elements have been measured and accounted for.

When the improved hanger device 110 illustrated in FIGS. 6–8 is disposed in its operative position an imaginary vertical straight line can be taken on the central axis of the aperture 134 and a vertical longitudinal axis can be taken on the wire member 126. The central axis of the aperture 134 is substantially coextensive to and laterally spaced from the longitudinal axis of the wire member 126. The diameter or width of the aperture 134 is sufficient to permit the free axial rotation of the screw fastener 112 without obstructing passage of the fastener head 122 during insertion. However, the diameter of the aperture 134 should be no wider than the diameter of the head 122 of the fastener 112.

In addition, the lateral spacing between the imaginary straight line taken on the central axis of the aperture 134 and the longitudinal vertical axis taken on the pendent wire body portion 128 should be at least as large—if not greater than—one-half the transverse dimension or diameter of the fastener head 122. Also, the lateral spacing between the imaginary line taken on the central axis of the aperture 134 and the wire body portion 128 of the wire member 126 is greater than the distance from the peripheral edge of the fastener head 122 to the longitudinal axis of the fastener 112. This lateral spacing will permit the peripheral edge of the fastener head 122 to freely rotate into or out of the beam 120 without contacting the adjacent and pendent wire body portion 128 when the fastener 112 is operatively extended through the aperture 134 and along the imaginary line of the central axis of the aperture 134.

It should be understood that in the alternate embodiments of the apparatus of the present invention, as illustrated in FIGS. 4–8, the length of the fasteners 38, 54, and 112 will be at least two and one-half inches, preferably three and one-half inches, and the gauge of the wires 40, 56, and 126 will preferably be 18 or 20. As with the preferred embodiment of the apparatus of the present invention, in the alternate embodiments, it is desired that the wire and the fastener should be manufactured and packaged together and assembled at the particular construction site.

Also, if the overhead surface lacks spanning joists, beams, or rafters, and is, instead, just an overhead ceiling, spaced-apart, pre-drilled holes may be drilled into the overhead ceiling at the appropriate distances and plastic wall anchors may be inserted therein. After placement of the wall anchors, adjustable and insertable securement of the fasteners into the ceiling anchors can occur. It should be noted that this method of securing the fastener into the overhead ceiling may not provide as much firm and long-lasting securement as the aforedescribed method of securing the fastener directly into the spanning joist. In addition, it should be noted in the alternate, embodiments of the apparatus of the present invention that each of the fasteners 38, 54, and 112 is a self-tapping screw, thus, pre-drilling holes into the overhead surface is unnecessary.

Furthermore, the preferred and alternate embodiments of the apparatus of the present invention can be used to hang and secure pipelines, conduit, and other types of longitudinally-extending cables. For hanging, supporting, and securing such items, the wire is tied or wrapped around the pipeline, etc., at appropriate points therealong. The weight of the material being suspended and supported would have to be considered, but both the preferred and alternate embodiments of the present invention can accomplish this task.

The foregoing is a description of a preferred embodiment of the invention and several alternate embodiments of the apparatus of the present invention. The apparatus of the present invention, in its preferred embodiment and in its alternate embodiments, is not to be taken as limited to any of the specific features as described, but comprehends all such variations thereof as come within the scope of the appended claims.

I claim:

1. An improved apparatus for hanging suspended ceiling structures from an overhead surface, such as a transversely-extending ceiling joist or beam, comprising:

an elongated screw fastener having a shank with a threaded end, a non-threaded portion, a neck portion, and an end adjacent the threaded end which defines a head adapted to be engaged by a tool to rotationally drive the fastener, and the neck portion having a width substantially less than the transverse dimension of the head;

a wire member, for vertical disposition and operative cooperation with the fastener, having an elongated body portion, means at a first end of the body portion for connection to part of a suspended ceiling structure, and an opposite second end having a ring-like shape defining an aperture to accommodate extension therethrough of the fastener, the aperture being disposed relative to the wire body portion whereby an imaginary straight line taken on the aperture's central axis is substantially coextensive to and laterally spaced from the longitudinal axis of the wire member, and the aperture being of sufficient width to permit free axial rotation during selective vertical adjustment of the fastener when the fastener is inserted into the overhead surface or removed therefrom;

the aperture having sufficient width so that the free axial rotation of the fastener during vertical adjustment into or out of the overhead surface does not twist the wire;

the lateral spacing between the imaginary straight line taken on the aperture's central axis and the wire body portion is at least as large as one-half the transverse dimension of the fastener head; and the wire member further characterized by the second end being an integral extension of the wire body portion.

2. The apparatus of claim 1 wherein the lateral spacing between the imaginary line and the body portion of the wire member is greater than the distance from the peripheral edge of the fastener head to the longitudinal axis of the fastener such that the peripheral edge will move free of contact with the wire member body portion when the fastener is operatively extended through the aperture along the imaginary line and is then rotated relative to the wire member.

* * * * *